US005421754A

United States Patent [19]

Lund-Andersen

[11] Patent Number: 5,421,754

[45] Date of Patent: Jun. 6, 1995

[54] ARRANGEMENT IN CONNECTION WITH A SWINGABLE TURN-UP ONBOARD/OUTBOARD STERN AGGREGATE FOR A CRAFT

[76] Inventor: Birger Lund-Andersen, Hoddalen 10, N-1600 Fredrikstad, Norway

[21] Appl. No.: 197,583

[22] Filed: Feb. 16, 1994

Related U.S. Application Data

[63] Continuation of Ser. No. 965,399, Dec. 18, 1992, abandoned.

[30] Foreign Application Priority Data

Jun. 20, 1990 [NO] Norway ..... 902737

[51] Int. Cl.[6] ..... B63H 5/12

[52] U.S. Cl. ..... 440/57; 440/75

[58] Field of Search ..... 440/49, 53, 57, 61, 440/75, 84, 86, 900

[56] References Cited

U.S. PATENT DOCUMENTS

| | | | |
|---|---|---|---|
| 4,565,532 | 1/1986 | Conner | 440/57 |
| 4,643,687 | 2/1987 | Yano et al. | 440/75 |
| 4,679,673 | 7/1987 | Yamaoka et al. | 440/75 |
| 4,767,365 | 8/1988 | Nakahama et al. | 440/75 |
| 5,018,996 | 5/1991 | Newman et al. | 440/75 |

*Primary Examiner*—Stephen P. Avila
*Attorney, Agent, or Firm*—Young & Thompson

[57] ABSTRACT

An arrangement in a swingable turn-up inboard/outboard stern aggregate (1) for craft with an inboard engine and an outboard driving unit (2) comprising a screw (5), where the inboard driving shaft (3) of the stern aggregate (1) for connection with the engine is connected with a screw shaft (4) which is approximately horizontal in a position for use and is mounted in the lower end of a housing (7) by the aid of a transmission shaft (6), which is divided into two sections (**6*a*, 6*b*) and surrounded by housing (7). The first section (6*a*) is at one end mounted (8) in the upper end of housing (7) and connected with driving shaft (3), via a first universal joint (A), and is at its other end, via an angular gear (B), connected with an upper end of section (6*b*) which is inclined rearwards and downwards. The lower end of second section (6*b*) is connected with screw shaft (4) at a firm angle (V), via a transmission (C) of torsional moment. In connection with angular gear (B) comprising two sets of angular gearwheels (B1, B2) a reversing unit (D) is provided to reverse the direction of rotation of lower section (6*b*) and, thus, the direction of movement of craft (10**).

11 Claims, 2 Drawing Sheets

ARRANGEMENT IN CONNECTION WITH A SWINGABLE TURN-UP ONBOARD/OUTBOARD STERN AGGREGATE FOR A CRAFT

This application is a continuation of application No. 07/965,399, filed Dec. 18, 1992, now abandoned.

FIELD OF THE INVENTION

The present invention relates to an arrangement in connection with a swingable turn-up inboard/outboard stern aggregate for craft with an inboard engine and an outboard drive unit comprising a screw, and of a kind as stated in the preamble of the following independent claim 1.

BACKGROUND OF THE INVENTION

Such a stern aggregate is known from the applicant's previous NO-PS No. 158 335, the object of which was to reduce dimensions, especially the transversal dimension, of the lower portion of the housing surrounding the propel shaft and screw shaft with bearings by using universal Joints between the propel shaft and the screw shaft.

In such a stern aggregate reversal of the direction of screw rotation may either be achieved by the aid of a gearbox in said inboard engine or, if desired, in the transmission from the latter to the stern aggregate.

The last mentioned concept will require space between the engine and the stern of the craft and it will also form an independent unit which has to be mounted, i.e. inserted between the stern aggregate and the engine.

SUMMARY OF THE INVENTION

It is an object of the present invention to provide a stern aggregate where such a gear or reversing means is part of the stern aggregate proper, so that such space as mentioned is saved, and labour for mounting is saved, since only the stern aggregate proper is to be mounted on the craft and connected with the engine.

According to the present invention the above object is achieved by the features recited the following independent claim 1, as well as in the following dependent claims.

BRIEF DESCRIPTION OF THE DRAWINGS

An embodiment of the invention will be disclosed in more detail below with reference to the drawings, in which.

DETAILED DESCRIPTION OF THE INVENTION

Figure 1:
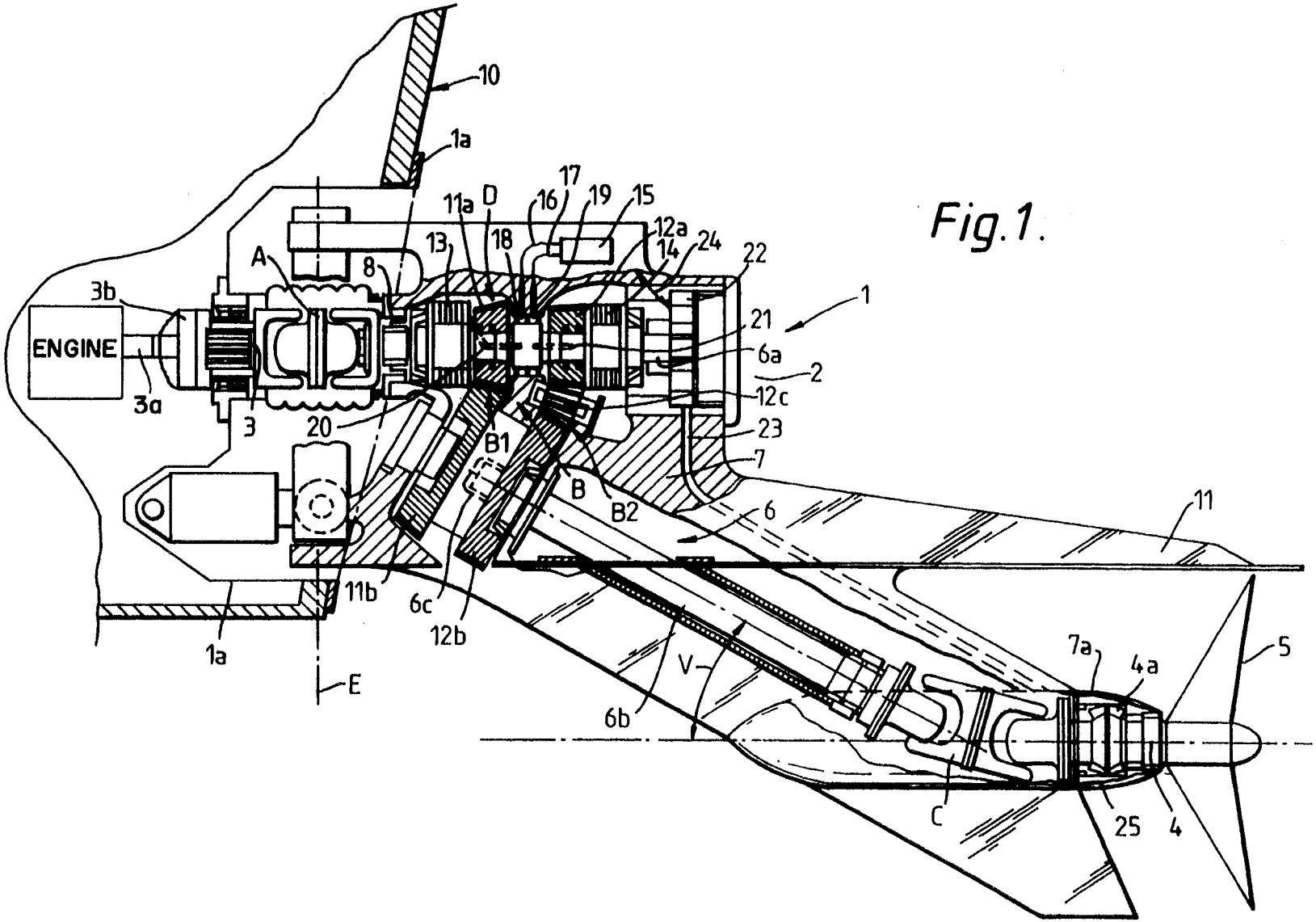
FIG. 1 is a side view and partly a sectional view of the stern aggregate, mounted on the stern of a craft.

FIG. 1 shows an inboard/outboard stern aggregate 1 the fastening means 1*a* of which is mounted on the stern of craft 10, and a driving unit 2 which is swingably fastened to fastening means 1*a*, via a horizontal transversal axis F (FIG. 2) and an approximately vertical axis E, for lifting, and lowering, respectively, of driving unit 2 and for swinging driving unit 2 to steer craft 10 in motion. In fastening means 1*a* an inboard driving shaft 3 is mounted for connection with output shaft 3*a*, via a flange coupling 3*b*. Via a double universal joint A driving shaft 3 is connected with a transmission shaft 6 which is divided into two sections 6*a*, 6*b*. The first section 6*a* is mounted at the upper end (8) of housing 7 and connected with said universal joint A, and its second end is connected with the second section 6*b* of transmission shaft 6, via angular gear B. The lower end of section 6*b* is, via a universal joint C, preferably a double universal joint, connected with a screw shaft 4, which is mounted in the lower rear end of housing 7, with a firm angle V between screw shaft 4 and lower section 6*b* of transmission shaft 6, which angle V is smaller than 45°, preferably 32°, with an approximately horizontal screw shaft 4. Universal joints A and C may, e.g. be of the ball-and-socket kind which may transmit high moments of torsion relative to its moderate external dimensions. When this transmission and screw shafts 6, 4 are used at the same time, housing 7 and a lower portion of the same which forms the screw housing 7*a*, may be built with small transversal dimensions. The screw housing may, thus, be made narrow to reduce its resistance to water flow.

The drawing, however, shows that universal joints of the cardan type are used in the present case, and it is especially important to be able to use a double universal joint of the cardan type forming a transmission means C for torsional moment between lower section 6*b* of transmission shaft 6 and screw shaft 4 so as to reduce the bending loads on the universal joint and, thus, to reduce any vibration and loss of transmitted torsional moment to screw 5.

Above screw 5 a stabilizing plate 11 is provided. It is fastened to and extends rearwards from housing 7 in an approximately horizontal plane and in the waterline when the craft is in motion.

Figure 2:
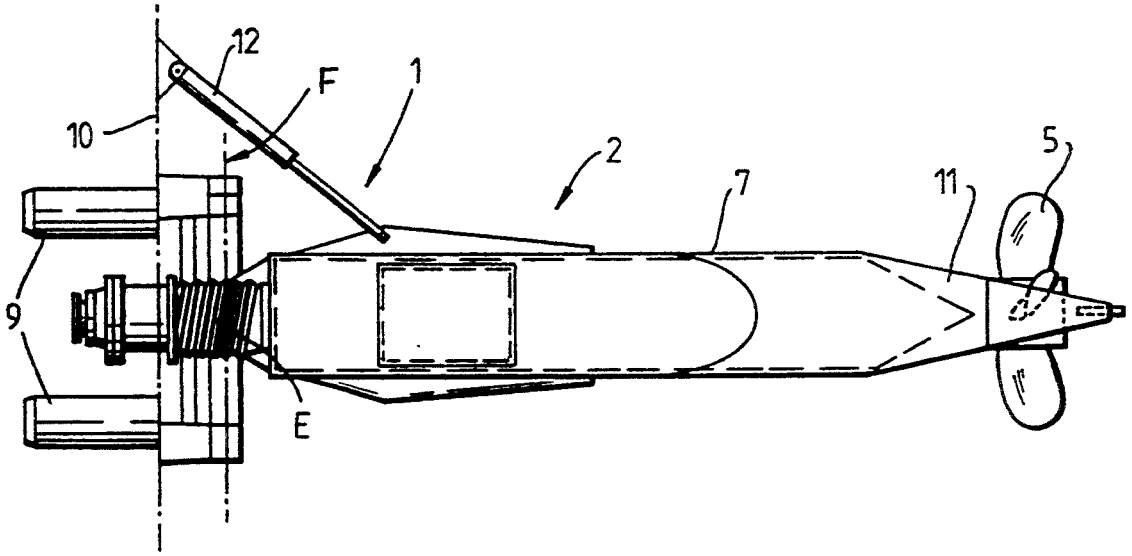
FIG. 2 is a diagrammatical top view of a stern aggregate with a pressure cylinder for lateral displacement of the stern aggregate for steering the craft and with pressure cylinders for turning the stern aggregate up and down into the water.

By the aid of pressure cylinders 9, which are fastened to fastening means 1*a* and housing 7, below the horizontal transverse axis F, driving unit 2 may be turned up and down and the inclined position of driving unit 2 is adjustable in order to provide the most suitable angle of attack of screw 5 in the direction of motion. In order to swing driving unit 2 about vertical axis E to steer the craft, a pressure cylinder 12 is provided as shown in FIG. 2.

The above mentioned reversing means for changing the direction of rotation of screw 5 as well as for cutting off the same is designated D and is arranged together with angular gear B connecting upper section 6*a* of transmission shaft 6 with its lower section 6*b*.

As shown in FIG. 1 angular gear B comprises two sets B1 and B2 of conical gears 11*a*, 11*b*, and 12*a*, 12*b*, with driving gears 11*a*, 12*a* being mounted to be engageable and disengageable on first/upper section 6a of transmission shaft 6 and being engaged with the driven gearwheels 11*b*, 12*b*, which are provided in a mutually non-rotatable engagement with the second section 6*b*. A conical intermediate gear 12*c* is arranged between the driving and the driven gear 12*a*, 12*b* to provide for opposite directions of rotation of section 6*b* when one or the other driving gear 11*a*, 12*a* is engaged, or disengaged, respectively.

In order to achieve said engagement and disengagement of the driving gears 11*a*, 12*a* of first section 6*a* clutches 13, 14 are provided in connection with respective gears 11*a*, 12*a* and are controlled from a maneuvering central 15.

Clutches 13, 14 are preferably air-oil actuated, the compressed fluid being supplied, via conduits 16, 17 in housing 7 to annular chambers 18, 19 in section 6*a* and, via bores 20, 21 in section 6*a* to a motor (not shown) In each clutch 13, 14. The clutches may be sliding clutches with one set of disks being fastened to section 6*a* and the other set being fastened to driving gears 11*a*, 12*a*, which two sets of frictional disks are made to contact each other by the aid of said pressure motor in each of the clutches 13, 14 by the aid of maneuvering central 15 which is controlled by suitable means from the driver's seat in craft 10.

In the embodiment as shown in FIG. 1, annular chambers 18, 19 are provided between driving gears 11*a*, 12*a* and may either consist of annular flanges, which are provided on section 6*a* and cooperate with an annular surface provided in housing 7, and with conduits 16, 17 opening into a respective annular chamber. The annular chamber, obviously, may consist of annular flanges extending inwards from said annular surface and being in contact with a corresponding external bearing surface on section 6*a*. From each of said annular chambers 18, 19 bores 20, 21 extend in section 6*a* to a pressure motor in each clutch 13, 14.

The driven gears 11*a*, 12*a* on section B are connected with each other in a manner preventing relative rotation, if desired, via splines 6*c*, and said gears may also be connected with section 6*b*, via said splines 6*c* to be mutually non-rotating. This is so to permit movement-/elongation of section 6*b*, among others in case of changes of temperature, without influencing the position of gears 11*b*, 12*b* relative to the driving gears 11*a*, 12*a*, and intermediate gear 12*c*.

A gear pump 22 is provided on section 6*a*, suitably at the outer end of the latter, and is, via piping 23, 24 connected with the lower portion of housing 7 comprising an oil sump 25 near propeller shaft 4 and bearing 4*a*, and with maneuvering central 15. From the maneuvering central piping 16, 17 extends to annular chambers 18, 19 and clutches 13, 14.

From maneuvring central 15 a return conduit (not shown) extends to oil sump 25 for return of pressure fluid when the maneuvering central is disengaged, or via pressure valves, respectively, when the maneuvering central is engaged for forward or rearward motion of the craft, i.e. in one or the other direction of rotation of screw 5.

Due to the fact that reversing gear/maneuvering central 15 has been moved from craft 10 adjacent to the engine or engine shaft, to the stern aggregate and is mounted with the driving means of the latter, the total dimensions are reduced, and an independent component and mounting of the same is avoided. With this arrangement of the reversing means D between the first section 6*a* of transmission shaft 6 and its second section 6*b*, a reduced torsional moment is achieved with high rpm of the first section of transmission shaft 6 and, consequently, of the first universal joint A between first section 6*a* of transmission shaft 6 and the driving shafts 3, because angular gears B1, B2 are designed to be reduction gears. Second section 6*b* of transmission shaft 6, thus, has lower rpm and a higher moment of torsion for transmission to screw 5. The first section 6*a* of transmission shaft 6 with associated components may, thus, be designed with smaller dimensions, whereas the second section 6*b* with associatd components must be designed with larger/stronger components for transmission of said higher moment of torsion.

I claim:

1. In an arrangement of a swingable turn-up inboard/-outboard stern aggregate for craft with an inboard engine and outboard driving unit comprising a screw, where an inboard driving shaft of the stern aggregate for connection with the engine is connected to a propeller shaft, which driving shaft is approximately horizontal in a position for use, and is mounted at a lower end of a housing, via a transmission shaft divided into a first section and a second section and surrounded by said housing, said first section has a first end and a second end, said second section has an upper end and a lower end, said first section is mounted at said first end in an upper end of said housing, and is connected via a first universal joint to said driving shaft, and said second end is connected to the upper end of said second section with an angular gear and the lower end of said second section is connected to said propeller shaft at an angle via a transmission means of torsional moment, the improvement wherein a gear together with a fluid actuated reversing means for reversing the direction of rotation of said second section are provided on one of said sections, whereby the rotational direction of the screw is reversed via a position where the first section of the transmission shaft is disengaged from second section.

2. An arrangement according to claim 1, wherein driving gears on the reversing means are alternatively connected to the first section, via a respective clutch which is controlled by a maneuvering central.

3. An arrangement according to claim 2, wherein the clutches are actuated by a pressurized fluid supplied via conduits in the housing to annular chambers on the first section and, via bores in the first section to a pressure motor in each clutch.

4. An arrangement according to claim 3, wherein the annular chambers are provided between the driving gears.

5. An arrangement according to claim 3, further including a gear pump provided on the first section, said gear pump being connected with a lower portion of the housing which comprises an oil sump and said maneuvering central including conduits connected to the annular chambers and clutches.

6. An arrangement according to claim 1, wherein the angular gear comprises two sets of conical gears, each having a driving gear and a driven gearwheel, said driving gears being mounted to be engageable and disengageable on the first section of the transmission shaft and being engaged with the driven gearwheels which are provided in a mutually non-rotatable engagement with the second section, and a conical intermediate gear being provided between the driving gears and the driven gearwheels for achieving an opposite direction of rotation of the second section when at least one of the driving gears is engaged.

7. An arrangement according to claim 6, wherein the driven gearwheels are mutually connected and are connected to the second section via splines.

8. In an arrangement of a swingable turn-up inboard/-outboard stern aggregate for a craft with an inboard engine and an outboard driving unit said arrangement comprising a screw, where an inboard driving shaft of the stern aggregate for connection with the engine is connected to a propeller shaft, which driving shaft is approximately horizontal in a position for use, and is mounted at a lower end of a housing, via an upwardly directed transmission shaft surrounded by said housing, having an upper end and a lower end, said transmission shaft is rotatably mounted at said upper end in an upper end region of said housing, and is rotatably linked with a first universal joint connecting to said driving shaft, and said lower end of said transmission shaft is connected to said propeller shaft at an acute angle relative thereto via a transmission means of torsional moment consisting of a double universal joint.

9. An arrangement according to claim 8, wherein the transmission shaft is divided into a first section and a second section, said first section having a first end and a second end, said second section having an upper end and a lower end, and said second end is connected to the upper end of said second section via a transmission means for torsional moment.

10. An arrangement according to claim 8, wherein the angles between a center axis of the double universal joint and the incoming section of the transmission shaft and the outgoing propeller shaft, are equal.

11. An arrangement according to claim 8, wherein the opposite universal joints of the double universal joint, are in phase.

* * * * *